US005253989A

United States Patent [19]

Shindo et al.

[11] Patent Number: 5,253,989

[45] Date of Patent: Oct. 19, 1993

[54] SCROLL FLUID APPARATUS HAVING A REVOLVING SCROLL OF SEPARATE MEMBERS

[75] Inventors: Manabu Shindo; Hiroshi Mitsuhashi; Susumu Sakamoto; Hiroyuki Kamagami; Minoru Machino, all of Kanagawa, Japan

[73] Assignee: Tokico Ltd., Kanagawa, Japan

[21] Appl. No.: 900,720

[22] Filed: Jun. 18, 1992

[30] Foreign Application Priority Data

Jun. 20, 1991 [JP] Japan ..... 3-176132

[51] Int. Cl.[5] ..... F01C 1/04; F01C 21/06

[52] U.S. Cl. ..... 418/55.2; 418/55.3; 418/83

[58] Field of Search ..... 418/55.2, 55.3, 83

[56] References Cited

U.S. PATENT DOCUMENTS 5,106,279 4/1992 Richardson, Jr. ..... 418/55.2

FOREIGN PATENT DOCUMENTS 59-34494 2/1984 Japan ..... 418/83
62-3101 1/1987 Japan ..... 418/55.3
62-78494 4/1987 Japan ..... 418/55.3
63-80086 4/1988 Japan ..... 418/55.2
2-157487 6/1990 Japan ..... 418/55.2

*Primary Examiner*—John J. Vrablik
*Attorney, Agent, or Firm*—Wenderoth, Lind & Ponack

[57] ABSTRACT

A scroll fluid apparatus has a revolving scroll and an auxiliary crank as a rotation prevention mechanism. The revolving scroll has a two-layer structure including an auxiliary member having an annular plate portion, and an end plate member having an end plate, the two members being superposed axially. A positioning mechanism is provided between the auxiliary member and the end plate member to position and unite them in a circumferential direction. When the end plate member expands radially due to a rise in temperature, the end plate is displaced radially while being in sliding contact with the annular plate portion. The end plate is fastened to the annular plate portion through a bolt portion at the center thereof, where the amount of radial displacement due to the thermal expansion is the smallest. Accordingly the annular plate portion is not displaced radially and thus, no radial load acts on the auxiliary crank.

8 Claims, 10 Drawing Sheets

SCROLL FLUID APPARATUS HAVING A REVOLVING SCROLL OF SEPARATE MEMBERS

BACKGROUND OF THE INVENTION

1. Field of the Invention

The present invention relates to a scroll fluid apparatus which may be employed for use in an air compressor, a vacuum pump, for example. More particularly, the present invention relates to a scroll fluid apparatus that is provided with an auxiliary crank as a rotation prevention mechanism.

2. Description of Prior Art

A typical known scroll fluid apparatus has a driving shaft that has a crank portion, a revolving scroll that is connected to the crank portion to revolve in response to the rotation of the driving shaft, and a fixed scroll that cooperates with the revolving scroll to compress a fluid. The temperature of the revolving scroll is raised by heat generated when it compresses the fluid, and by heat generated from a bearing portion disposed between the revolving scroll and the crank portion. Since the revolving scroll is connected to auxiliary cranks such that it revolves without rotating around its own axis, the revolving scroll inevitably has a large thickness, so that when it is heated, its temperature does not rise uniformly, resulting in a warping of the revolving scroll. In addition, since the allowable change in position of the auxiliary cranks is not large, a large force is applied to the auxiliary cranks by the thermal expansion of the revolving scroll, which may give rise to problems such as breakage. The revolving and fixed scrolls each have an end plate one face of which is mirror-finished. Thus, deformation of the end plate is a serious problem.

SUMMARY OF THE INVENTION

In view of the above it is an object of the present invention to provide a scroll fluid apparatus which is free from the above-described problems of the prior art.

The present invention provides a scroll fluid apparatus comprising a cylindrical casing; a drive shaft rotatably supported by the casing at one end portion of the casing and having a crank at one end of the drive shaft located in the casing; a revolving scroll having a first spiral scroll wrap and a boss portion which connects the revolving scroll to the crank for permitting revolving movement of the revolving scroll; a fixed scroll secured to the other end of the casing in opposing relation to the revolving scroll and having an end plate and a second spiral scroll wrap which defines, in cooperation with the first scroll wrap, a plurality of compression chambers; and an auxiliary crank connected at one end thereof to the casing and at the other end thereof to the rear side of the revolving scroll to prevent rotation of the revolving scroll.

To achieve the aforesaid object, the revolving scroll in the apparatus according to the invention comprises an auxiliary member connected to the other end of the auxiliary crank and an end plate member disposed on the side of the auxiliary member which faces the fixed scroll member. The first scroll wrap is provided on the end plate member. The revolving scroll also has positioning means provided between the auxiliary member and the end plate member and including an engagement groove formed radially in one of the auxiliary member and the end plate member and an engagement projection provided on the other of these member, and fitted in the engagement groove.

BRIEF DESCRIPTION OF THE DRAWINGS

The above and other objects, features and advantages of the present invention will become more apparent from the following description of the preferred embodiments thereof, taken in conjunction with the accompanying drawings, in which like reference numerals denote like elements, and of which.

DETAILED DESCRIPTION OF THE PREFERRED EMBODIMENTS

Figure 9:
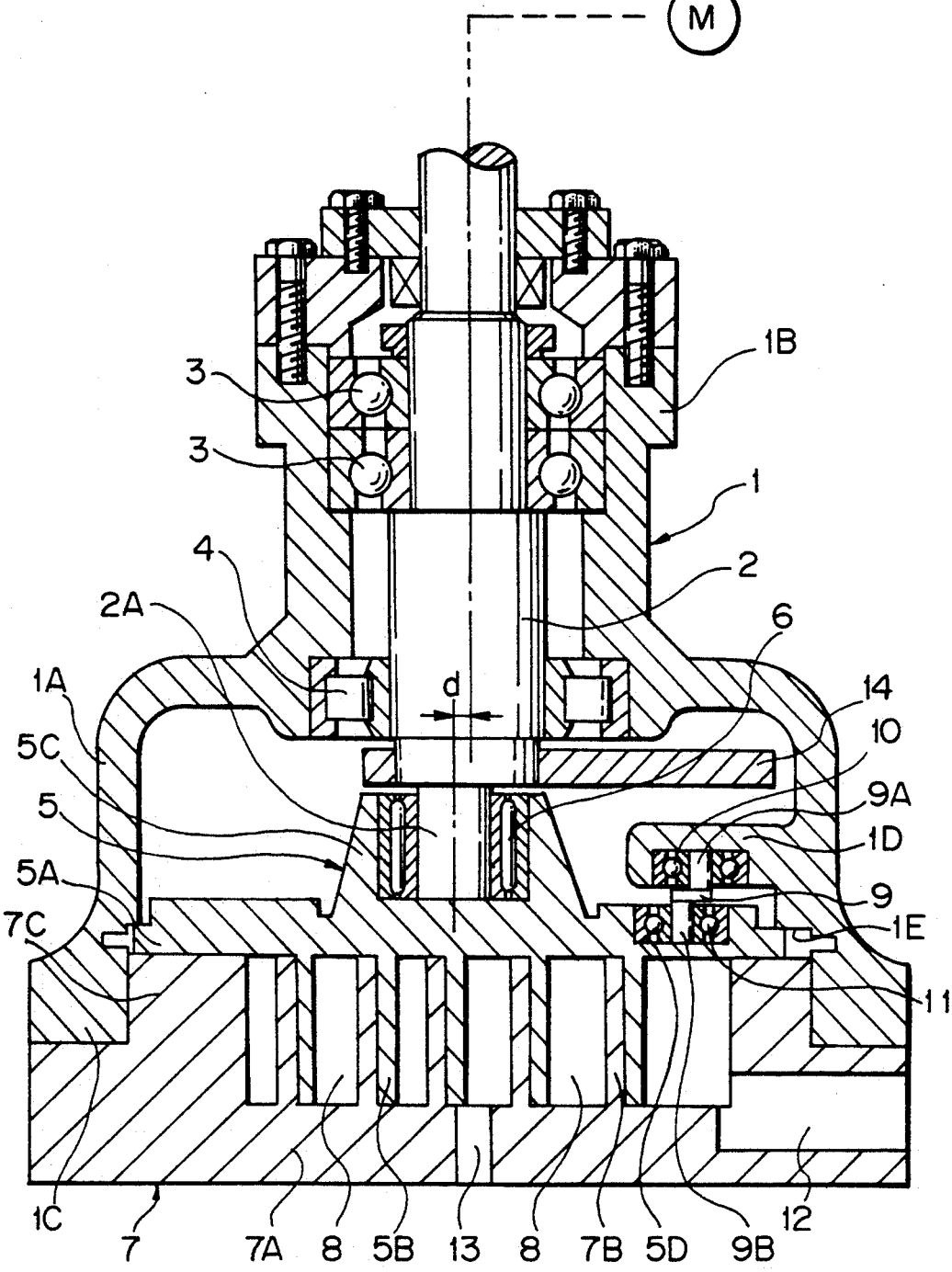
Fig. 9 PRIOR ART
FIG. 9 is a vertical sectional view of a scroll air compressor according to the prior art.
Figure 10:
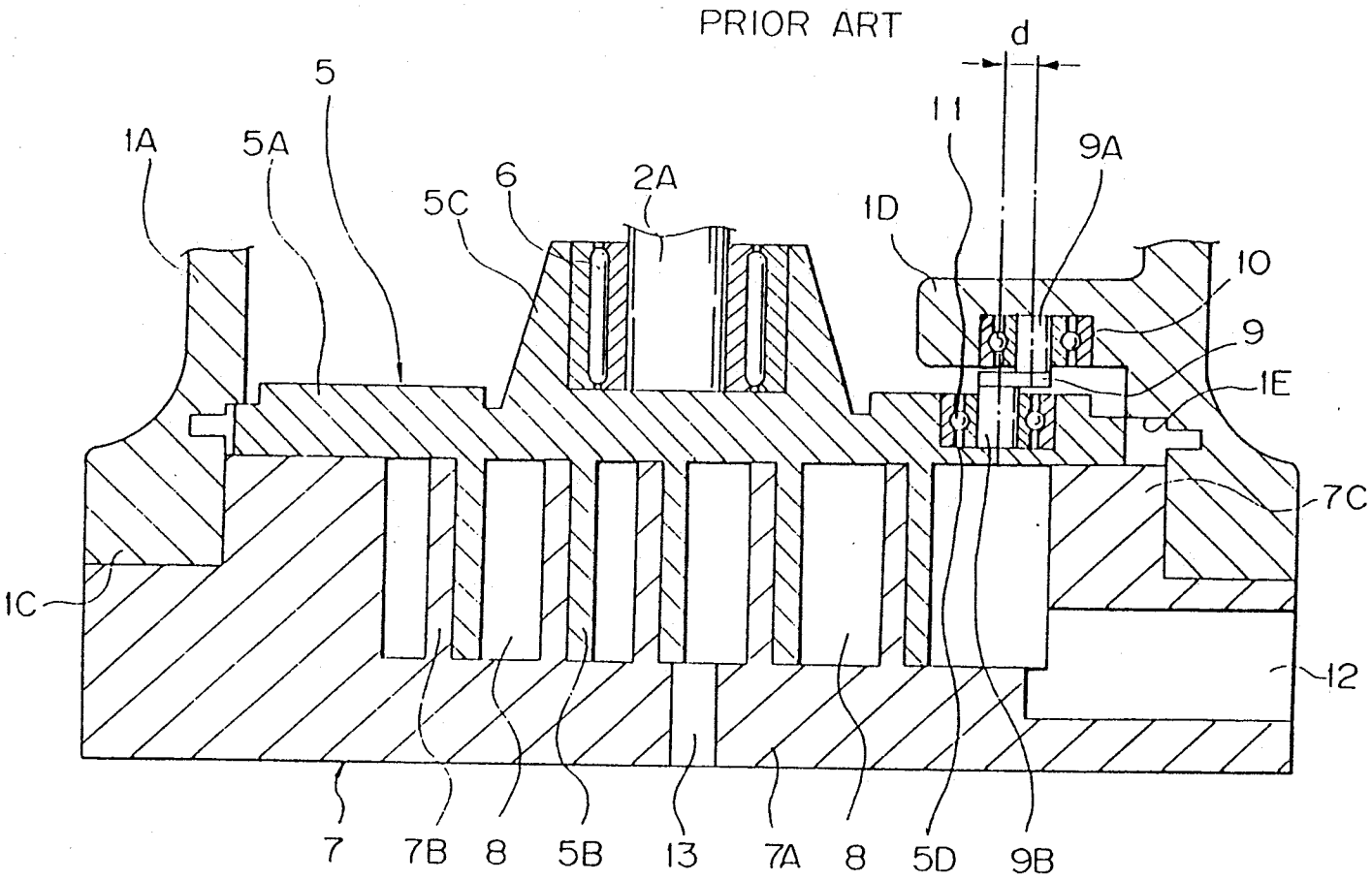
FIG. 10 is a sectional view of an essential part of the scroll air compressor shown in FIG. 9.

FIGS. 9 and 10 show an oil-free scroll air compressor as an example of a scroll fluid apparatus according to the prior art.

Referring to these figures, a casing 1, which is in the shape of a stepped cylinder, comprises a large-diameter cylindrical portion 1A, a bearing portion 1B that projects from one end of the large-diameter cylindrical portion 1A toward one axial end of the casing 1, and a flange portion 1C formed at the other end of the large-diameter cylindrical portion 1A as an integral part thereof. The inner periphery of the large-diameter cylindrical portion 1A is formed with three bearing accommodating portions 1D (only one being shown in the figures) projecting radially inward and a thrust bearing portion 1E that is in sliding contact with the rear face of a revolving scroll 5 (described later) to bear a thrust load. In addition, the large-diameter cylindrical portion 1A is provided with an air vent (not shown) to allow the ambient air to flow into the large-diameter cylindrical portion 1A.

A driving shaft 2 is rotatably supported by the bearing portion 1B of the casing 1 through bearings 3 and 4. The inner end portion of the driving shaft 2 extends into the large-diameter cylindrical portion 1A of the casing 1 to define a crank 2A. The axis of the crank 2A is eccentric with respect to the axis of the driving shaft 2 by a predetermined distance "d". The outer end portion of the driving shaft 2 projects outside from the bearing portion 1B of the casing 1 and is connected to an electric motor M through a pulley (not shown) so as to be rotated by the motor M.

A revolving scroll 5 is disposed inside the casing 1 and is provided on the crank 2A of the driving shaft 2. The revolving scroll 5 comprises a disk-shaped end plate 5A having a finely finished surface portion, a spiral scroll wrap 5B provided on the end plate 5A in such a manner that it begins to spiral at its end near the center of the end plate 5A and terminates at its other end near the outer periphery thereof, and a boss portion 5C provided at the center of the rear side of the end plate 5A. The boss portion 5C carries the crank 2A of the driving shaft 2 through an orbiting bearing 6. The outer peripheral portion of the rear side of the end plate 5A is formed with three bearing accommodating holes 5D (only one being shown) that accommodate auxiliary crank bearings 11 (described later).

A fixed scroll 7 is rigidly secured to the other end of the large-diameter cylindrical portion 1A of the casing 1 through mounting bolts (not shown) in opposing relation to the revolving scroll 5. The fixed scroll 7 comprises an end plate 7A the center of which is coincident with the axis of the driving shaft 2, that is, the central axis of the scroll air compressor, and a spiral scroll wrap 7B projecting from the end plate 7A in the same way as in the case of the scroll wrap 5B of the revolving scroll 5. In addition, one end face of the fixed scroll 7 is formed with a thrust bearing portion 7C that is in sliding contact with the end plate 5A of the revolving scroll 5 to bear a thrust load. The surface portions of the fixed scroll 7 that slidably engages the revolving scroll 5 are also finely finished.

The scroll wrap 7B of the fixed scroll 7 is so disposed with respect to the scroll wrap 5B of the revolving scroll 5 as to provide contact points circumferentially displaced by a predetermined angle, so that when the revolving scroll 5 revolves, a plurality of successively contracting compression chambers 8 are defined between the scroll wraps 7B and 5B.

A plurality (e.g., three) of circumferentially spaced auxiliary cranks 9 (only one being shown) are disposed between the bearing accommodating portions 1D of the casing 1 and the end plate 5A of the revolving scroll 5 to serve as a rotation preventing mechanism. As shown also in FIG. 10, the auxiliary cranks 9 each have a shaft portion 9A at one end thereof, which is received in the corresponding bearing accommodating portion 1D of the casing 1 through an auxiliary crank bearing 10, and a shaft portion 9B at the other end, which is received in the corresponding bearing accommodating hole 5D of the revolving scroll 5 through an auxiliary crank bearing 11. The two shaft portions 9A and 9B are eccentric with respect to each other by a predetermined dimension "d". The auxiliary cranks 9 prevent rotation of the revolving scroll 5 about its own axis when moved along a circular path with a radius equal to the dimension "d" by the driving shaft 2, thereby causing the revolving scroll 5 to revolve about the axis of the driving shaft 2.

In addition, a suction opening 12 is provided in the outer periphery of the fixed scroll 7, and a discharge opening 13 is provided in the end plate 7A of the fixed scroll 7. The suction opening 12 communicates with the outermost (lowest pressure) compression chamber 8, while the discharge opening 13 communicates with the innermost (highest pressure) compression chamber 8. Reference numeral 14 denotes a counterweight that is rigidly secured to the driving shaft 2 to realize a well-balanced rotation of the shaft 2.

With the above-described arrangement, the scroll air compressor according to the prior art operates as follows. As the driving shaft 2 is rotated by the electric motor M, the rotation of the driving shaft 2 is transmitted to the revolving scroll 5 from the crank 2A through the orbiting bearing 6, causing the revolving scroll 5 to revolve about the axis of the driving shaft 2 while being prevented from rotating around its own axis by the auxiliary cranks 9. In response to this orbiting motion of the revolving scroll 5, the compression chambers 8, which are defined by the scroll wraps 5B and 7B, contract successively, so that the air sucked in from the suction opening 12 is successively compressed in the compression chambers 8, and the compressed air is discharged into an external air tank or the like from the discharge opening 13, thus performing a compression operation.

The above-described prior art suffers, however, from the following problems. During the compression operation, compression heat corresponding to the discharge pressure is generated in each compression chamber 8, and frictional heat is also generated in the orbiting bearing 6. Accordingly, the temperature of the revolving scroll 5 is raised by the compression heat and the frictional heat, resulting in the revolving scroll 5 expanding thermally by a large margin. In the oil-free scroll air compressor, thermal expansion due to the rise in temperature is particularly remarkable because the revolving scroll 5 is not cooled by a lubricating oil. On the other hand, the casing 1 that surrounds the outer periphery of the revolving scroll 5 experiences a smaller degree of temperature rise and also a smaller extent of thermal expansion than the revolving scroll 5 because the surface of the casing 1 is exposed to the ambient air and is thus cooled.

Thus, in the above-described prior art, a large difference in thermal expansion is present between the revolving scroll 5 and the casing 1. Accordingly, as the revolving scroll 5 expands radially due to heat, a strong radial load acts on the auxiliary cranks 9, thus preventing a smooth revolution of the revolving scroll 5, and resulting in a marked increase in power loss. In addition, various problems may arise such as a, breakage of the auxiliary cranks 9, a decrease in the lifetime of the auxiliary crank bearings 10 and 11, and a marked lowering in the compression efficiency, durability and reliability. In addition, since there is a difference in temperature rise due to compression heat between the scroll wrap (5B) side of the revolving scroll 5 and the rear side of the end plate 5A, warping occurs.

Embodiments of the present invention will be described below with reference to FIGS. 1 to 8. It should be noted that in the embodiments the same constituent elements as those in the prior art shown in FIGS. 9 and 10 are denoted by the same reference numerals and a description thereof is omitted.

Figure 1:
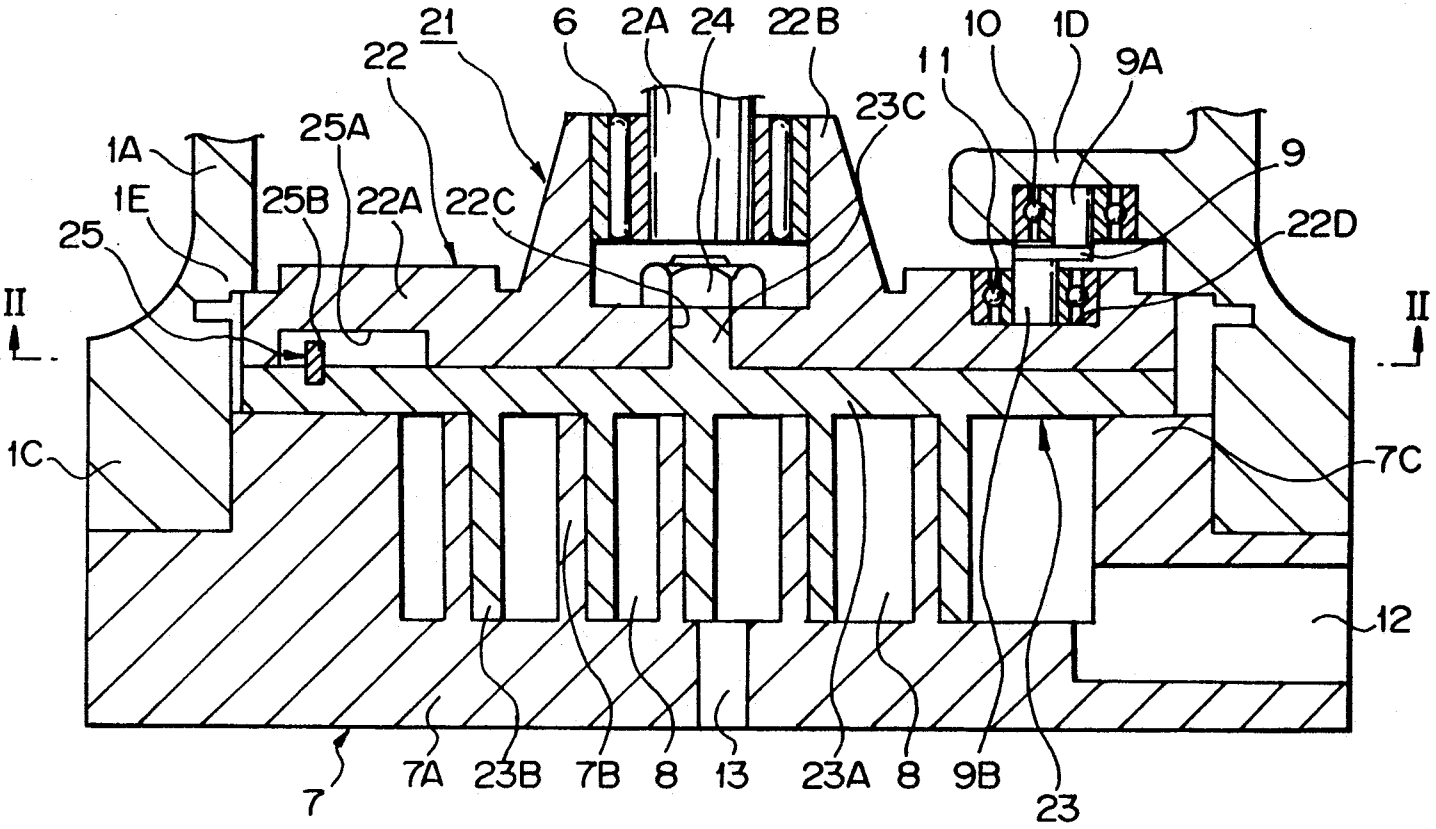
FIG. 1 is a vertical sectional view of an essential part of a scroll air compressor according to a first embodiment of the present invention.
Figure 2:
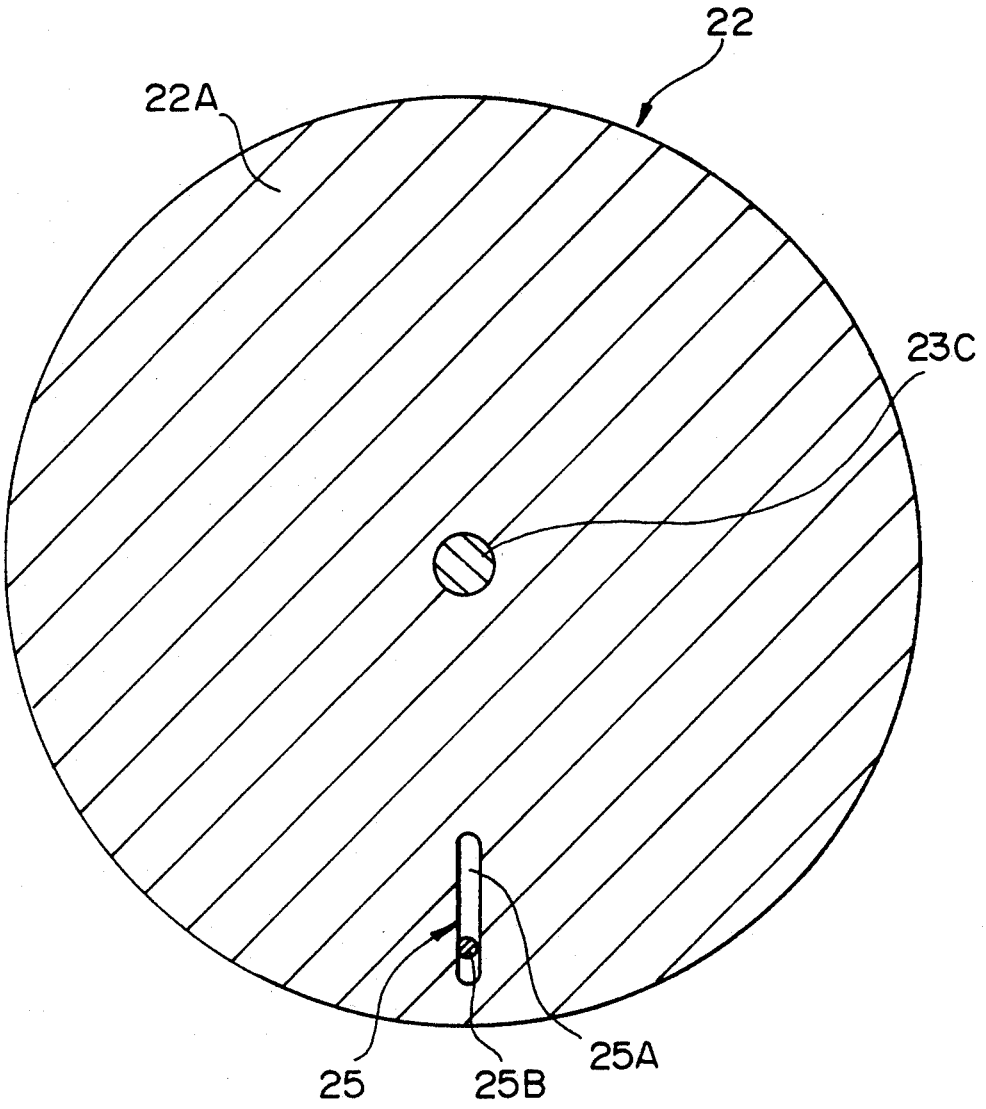
FIG. 2 is a sectional view taken along the line II—II in FIG. 1, which shows an auxiliary member of a revolving scroll in the scroll air compressor.

Referring to FIGS. 1 and 2, which show a first embodiment of the present invention, a revolving scroll 21 is provided in the large-diameter cylindrical portion 1A of the casing 1 in substantially the same way as in the case of the revolving scroll 5 in the prior art. However, the revolving scroll 21 in this embodiment has a two-layer structure comprising an auxiliary member 22 and an end plate member 23, which will be described later.

The auxiliary member 22 is provided at one end of the revolving scroll 21 inbetween the bearing accommodating portions 1D of the casing 1 and the fixed scroll 7. The auxiliary member 22 is provided on one side of an end plate 23A of the end plate member 23. If the end plate member 23 is made of aluminum, for example, the auxiliary member 22 is formed by using a ferrous material, e.g., cast iron, which has a smaller coefficient of thermal expansion and a lower thermal conductivity than those of aluminum. The auxiliary member 22 comprises an annular plate portion 22A, and a boss portion 22B that projects from the center of the rear side of the annular plate portion 22A toward one axial end of the scroll air compressor to receive the crank 2A of the driving shaft 2. The center of the annular plate portion 22A is provided with a mounting hole 22C for receiving a bolt portion 23C of the end plate member 23, the hole 22C being coaxial with the crank 2A. The outer peripheral portion of the rear side of the annular plate portion 22A is formed with three circumferentially spaced bearing accommodating holes 22D (only one being shown) for accommodating auxiliary crank bearings 11.

The end plate member 23 is provided at the other end of the revolving scroll 21 inbetween the auxiliary member 22 and the fixed scroll 7. The end plate member 23 comprises a disk-shaped end plate 23A, a spiral scroll wrap 23B projecting from the end plate 23A, and the bolt portion 23C projecting from the center of the rear side of the end plate 23A. The bolt portion 23C is fitted into the mounting hole 22 of the auxiliary member 22 and fastened by a nut 24 inside the boss portion 22B. Thus, the bolt portion 23C fastens the end plate member 23 to the auxiliary member 22 at the center of the end plate 23A, where the amount of radial displacement due to thermal expansion is the smallest.

A positioning mechanism 25, serving as a positioning means, is provided between the auxiliary member 22 and the end plate member 23. As shown also in FIG. 2, the positioning mechanism 25 comprises an engagement groove 25A that is formed radially in the forward end face of the annular plate portion 22A at a position closer to the outer periphery thereof, and an engagement projection 25B the proximal end portion of which is press-fitted into the outer periphery of the rear side of the end plate 23A of the end plate member 23. The distal end portion of the projection 25B extends into the engagement groove 25A with a predetermined gap being provided between the distal end of the engagement projection 25B and the bottom of the engagement groove 25A. The positioning mechanism 25 unites the auxiliary member 22 and the end plate member 23 with respect to the circumferential direction, thereby positioning them circumferentially by virtue of the engagement between the projection 25B and the auxiliary member 23 within the groove 25A, thereby enabling the members 22 and 23 to orbit together as one unit when the driving shaft 2 rotates.

The scroll air compressor according to this embodiment, having the above-described arrangement, is not particularly different from the prior art in its basic operation.

However, according to this embodiment, the revolving scroll 21 has a two-layer structure comprising the auxiliary member 22 and the end plate member 23, and the positioning mechanism 25 is provided inbetween the auxiliary member 22 and the end plate member 23 to position and unite together the members 22 and 23. Accordingly, as the driving shaft 2 rotates, the auxiliary member 22 and the end plate member 23 orbit together as one unit about the axis of the crank 2A, thereby successively contracting the compression chambers 8, and thus enabling a compression operation to be performed.

When the end plate member 23 expands radially due to a rise in the temperature caused by the compression heat in each compression chamber 8, the end plate 23A is displaced radially while being in sliding contact with the annular plate portion 22A of the auxiliary member 22. However, the revolving scroll 21 has a two-layer structure comprising the auxiliary member 22 and the end plate member 23, and the end plate 23A of the end plate member 23 is fastened through the bolt portion 23C to the annular plate portion 22A of the auxiliary member 22 at the center thereof, where the amount of radial displacement due to the thermal expansion is the smallest. Therefore, the revolving scroll 21 can be effectively prevented from warping owing to the difference in thermal expansion between the forward side (i.e., the compression chamber (8) side) and the rear side (i.e., the boss portion (22B) side), and the annular plate portion 22A of the auxiliary member 22 can be reliably prevented from being displaced radially, following the end plate 23A. In addition, since the auxiliary member 22 is formed by using a ferrous material, e.g., cast iron, which has a smaller coefficient of thermal expansion and a lower thermal conductivity than those of aluminum, it is possible to prevent thermal expansion of the auxiliary member 22 due to the heat from the end plate member 23, and the conduction of this heat to the auxiliary crank bearings 11 can be effectively prevented.

As a result, even when the end plate 23A of the end plate member 23 expands thermally, no radial load acts on the auxiliary cranks 9. Therefore it is possible to effectively prevent the auxiliary cranks 9 from breaking. In addition, the revolving scroll 21 can be revolved smoothly, so that it is possible to improve the compression efficiency and other performances as well as durability and reliability by a large margin. It is also possible to effectively prevent the application of force to the auxiliary crank bearings 10 and 11 from the end plate 23A of the end plate member 23 due to thermal expansion during the compression operation and hence, it is possible to extend the lifetime of the auxiliary crank bearings 10 and 11 by a large margin.

Figure 3:
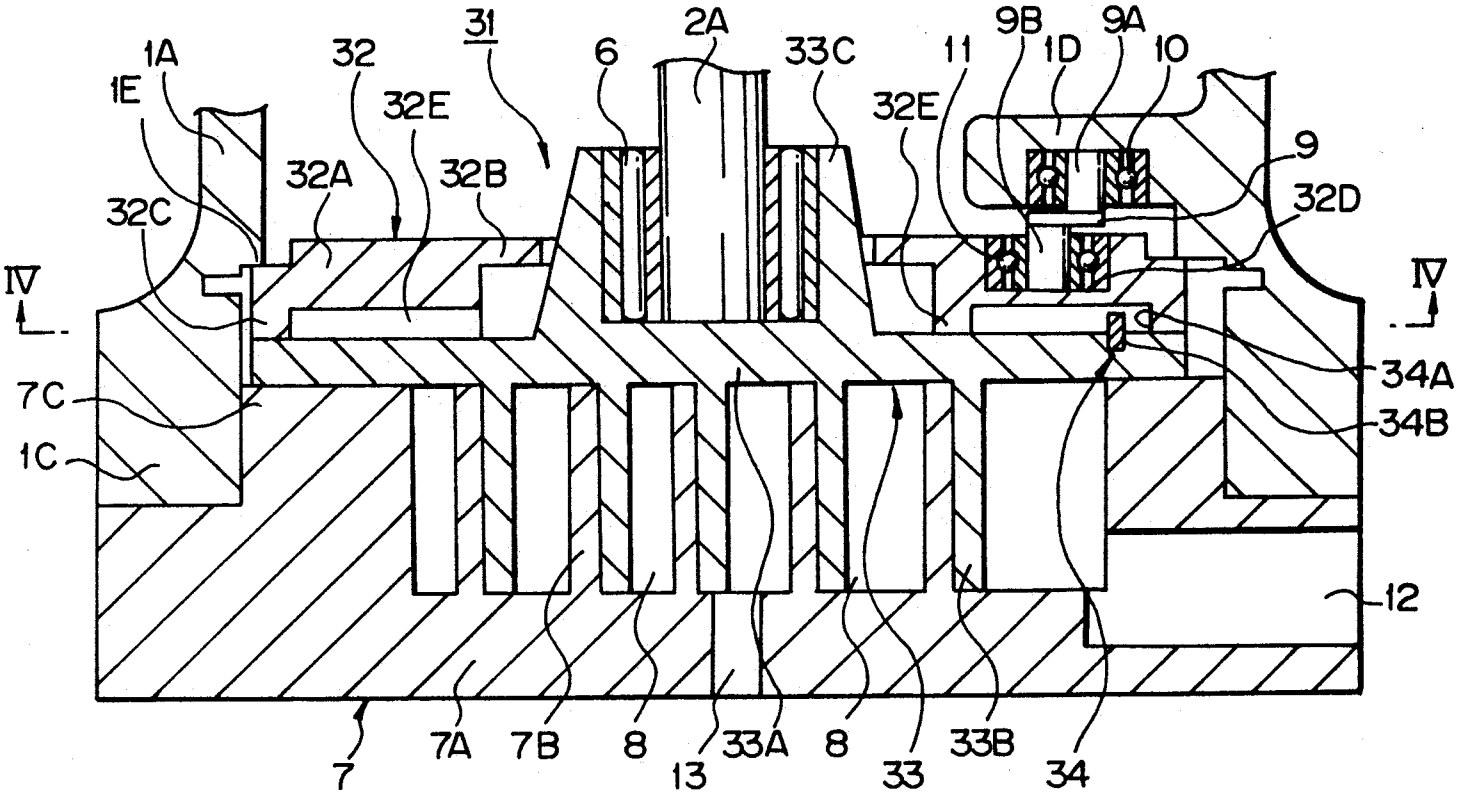
FIG. 3 is a vertical sectional view of an essential part of a scroll air compressor according to a second embodiment of the present invention.
Figure 4:
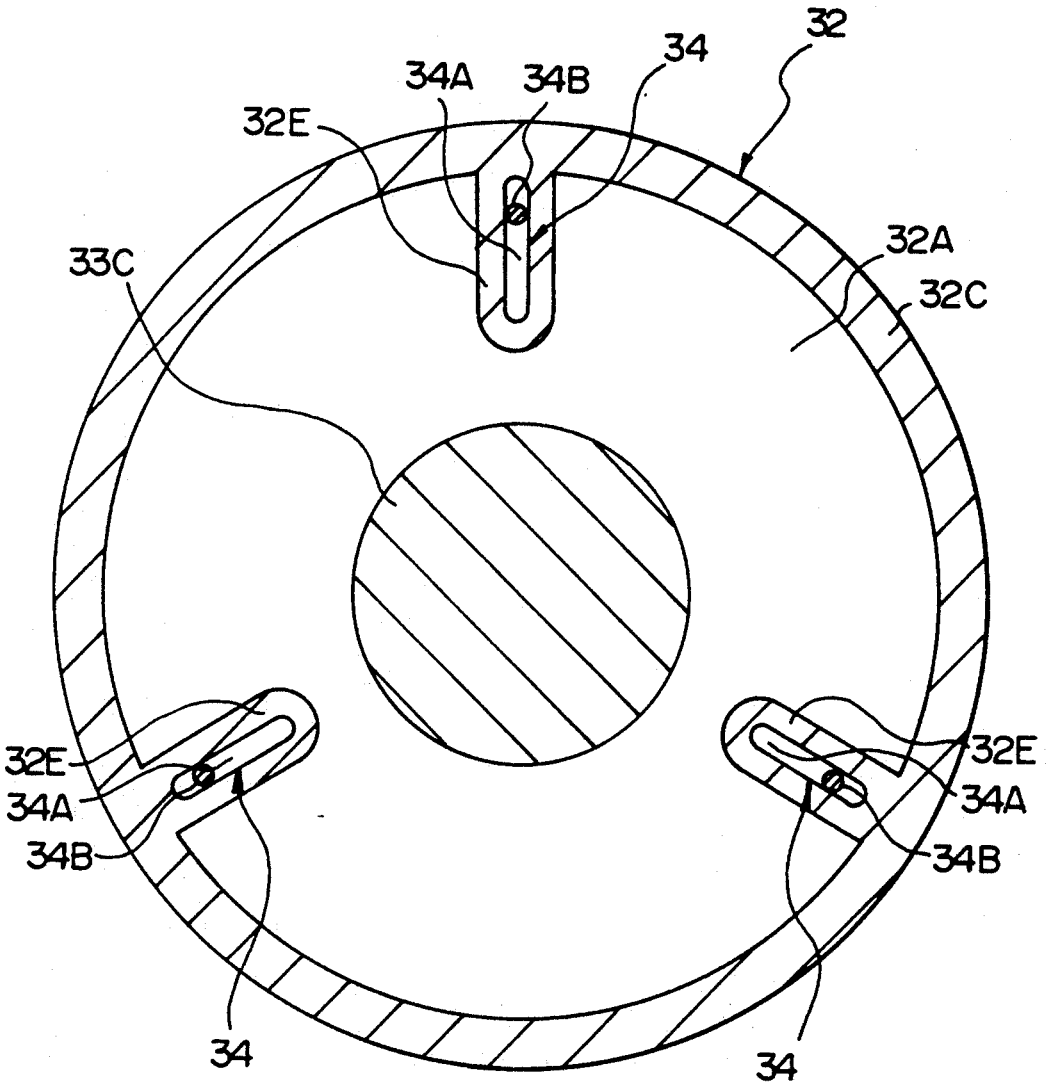
FIG. 4 is a sectional view taken along the line IV—IV in FIG. 3, which shows an auxiliary member of a revolving scroll in the scroll air compressor shown in FIG. 3.
Figure 5:
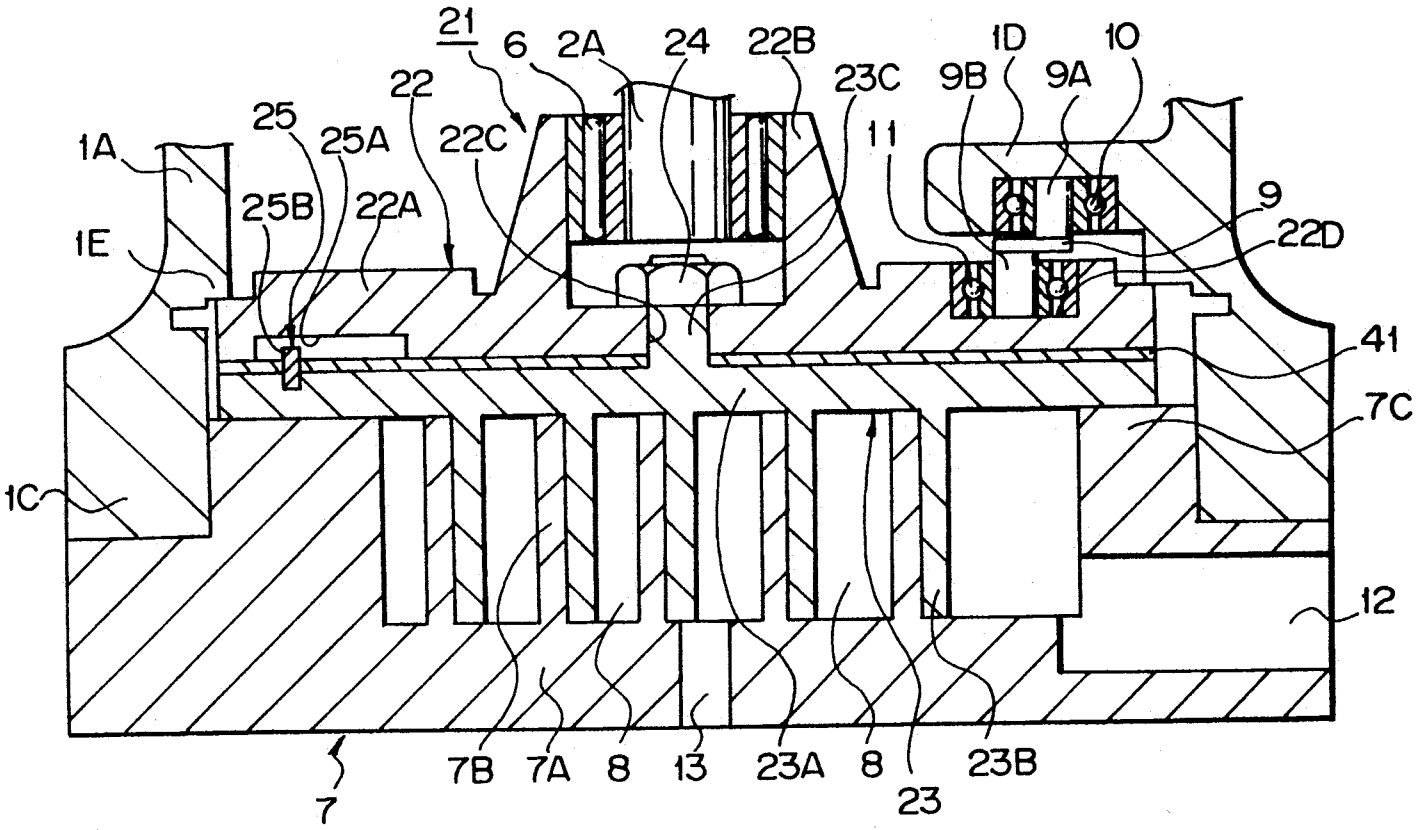
FIG. 5 is a vertical sectional view similar to FIG. 1, which shows a first modification of the present invention.
Figure 6:
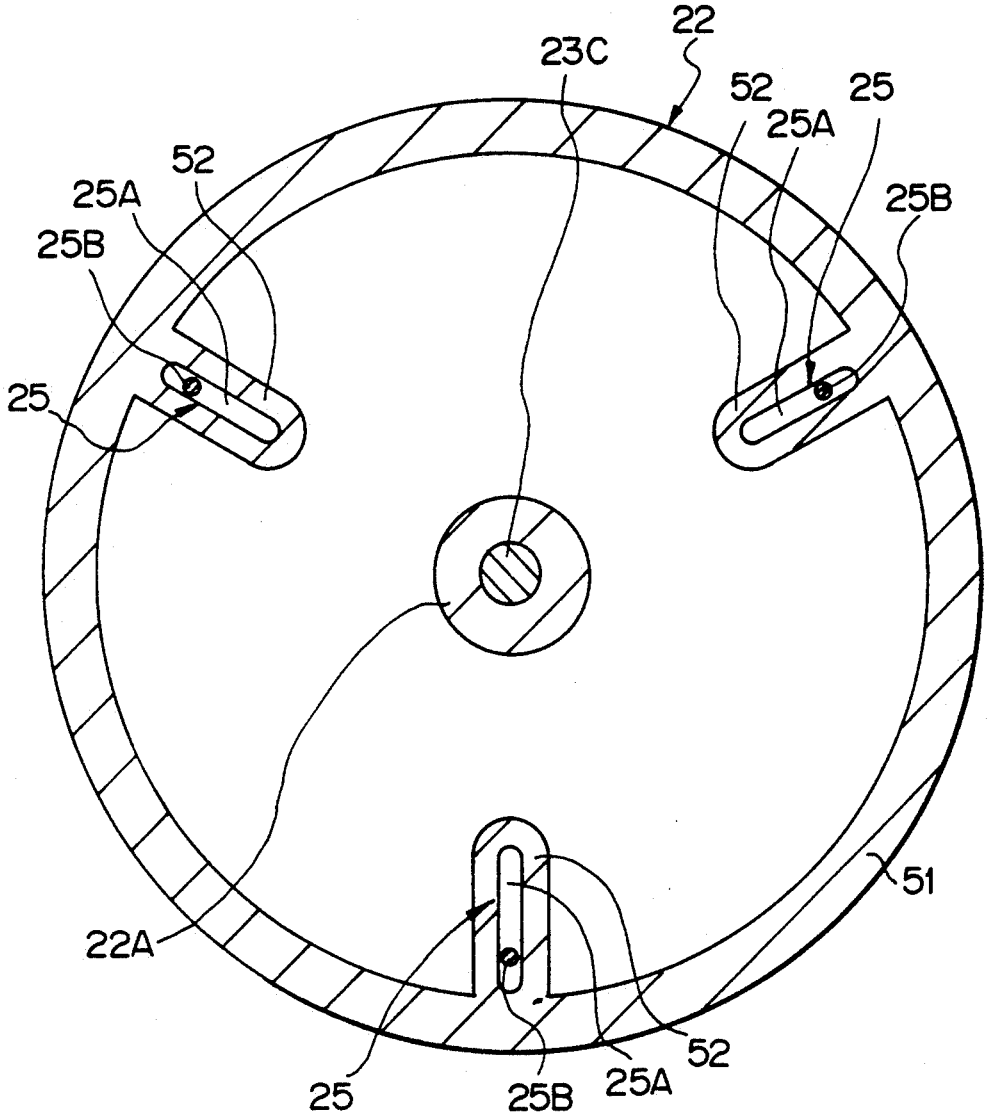
FIG. 6 is a sectional view similar to FIG. 2, which shows a second modification of the present invention.
Figure 7:
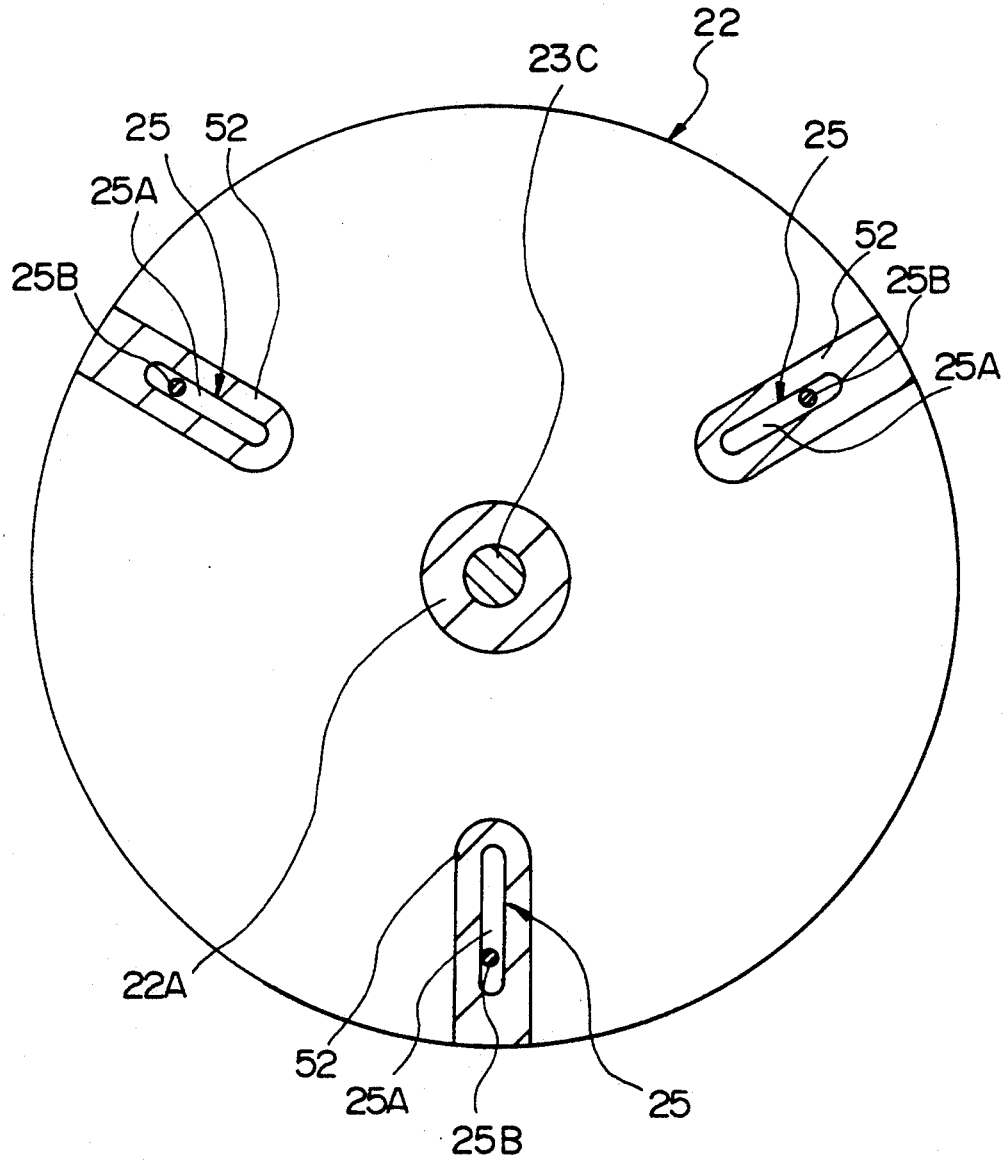
FIG. 7 is a sectional view similar to FIG. 2, which shows a third modification of the present invention.
Figure 8:
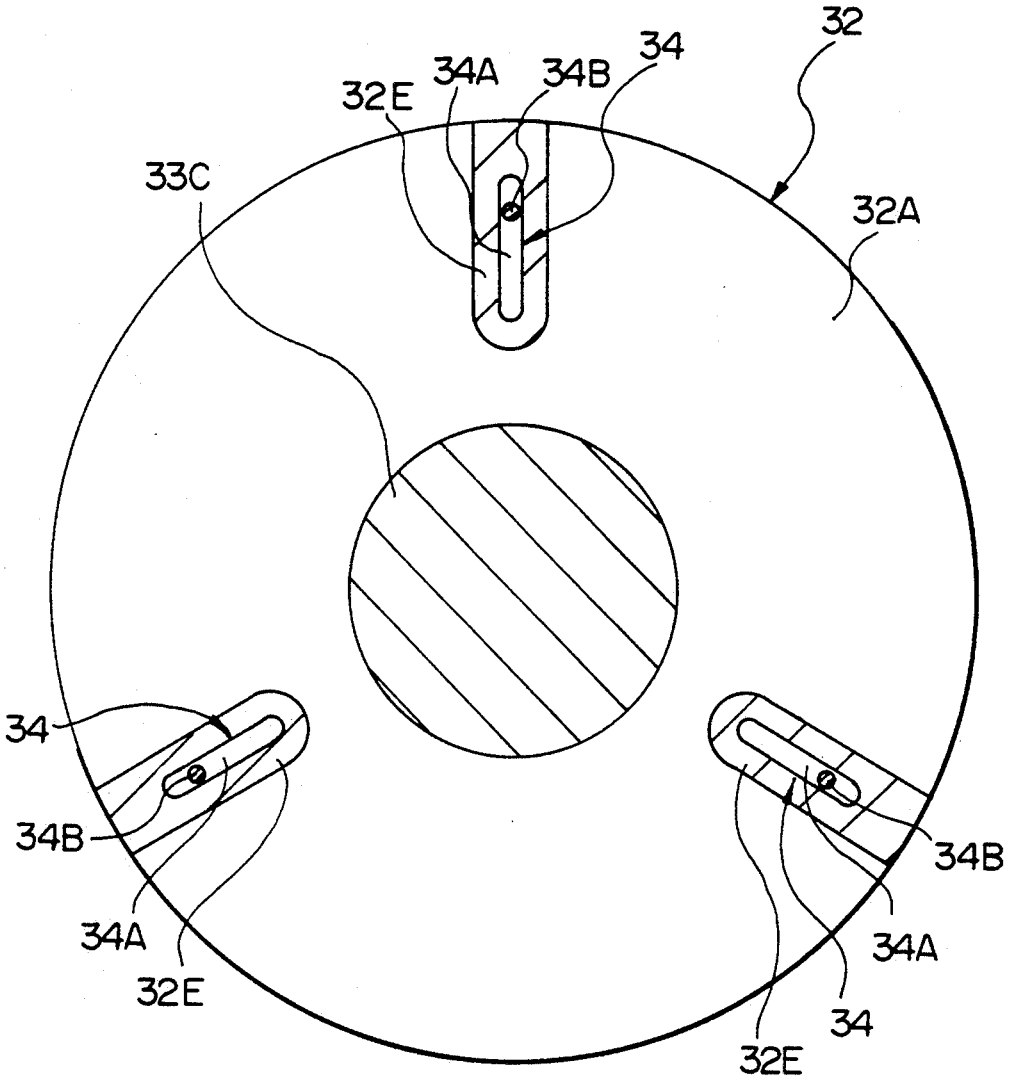
FIG. 8 is a sectional view similar to FIG. 4, which shows a fourth modification of the present invention.

FIGS. 3 and 4 show a second embodiment of the present invention. The characterizing feature of this embodiment resides in that the auxiliary member is in contact with the end plate member only at the outer periphery thereof.

Referring to FIG. 3, a revolving scroll 31 in this embodiment has a two-layer structure comprising an auxiliary member 32 and an end plate member 33 (described later) which are substantially the same as the members of the revolving scroll 21 in the first embodiment. However, the auxiliary member 32 is in contact with the end plate member 33 only at the outer periphery thereof.

The auxiliary member 32 is provided at one end of the revolving scroll 31 inbetween the bearing accommodating portions 1D of the casing 1 and the fixed scroll 7. The auxiliary member 32 comprises an annular plate portion 32A that is disposed at the outer periphery of one end face of an end plate 33A of the end plate member 33, a thin-walled annular mounting portion 32B projecting radially inward from the inner periphery of the annular plate portion 32A as an integral part thereof so as to be loosely fitted on a boss portion 33C of the end plate member 33, and an annular wall portion 32C projecting from the outer periphery of the annular plate portion 32A as an integral part thereof. When the end plate member 33 is made of aluminum, for example, the auxiliary member 32 is formed by using a ferrous material, e.g. cast iron, which has a smaller coefficient of thermal expansion and a lower thermal conductivity than those of aluminum. One end face of the annular plate portion 32A is formed with three circumferentially spaced bearing accommodating holes 32D (only one being shown) for accommodating auxiliary crank bearings 11. The inner periphery of the annular wall portion 32C is formed with three circumferentially spaced raised portions 32E, which extend toward the center, as shown in FIG. 4.

The end plate member 33 is provided at the other end of the revolving scroll 31 in between the auxiliary member 32 and the fixed scroll 7. The end plate member 33 comprises a disk-shaped end plate 33A, a spiral scroll wrap 33B projecting from the end plate 33A, and a boss portion 33C projecting from the center of the rear side of the end plate 33A to receive the crank 2A of the driving shaft 2 through the orbiting bearing 6.

A plurality (e.g., three) of positioning mechanisms 34, serving as positioning means, are provided inbetween the auxiliary member 32 and the end plate member 33. As shown also in FIG. 4, each positioning mechanism 34 comprises an engagement groove 34A that is formed radially in each raised portion 32E of the auxiliary member 32, and an engagement projection 34B the proximal end portion of which is press-fitted into the outer periphery of the rear side of the end plate 33A of the end plate member 33. The distal end portion of the projection 34B extends into the corresponding engagement groove 34A with a predetermined gap being provided between the distal end of the engagement projection 34B and the bottom of the engagement groove 34A. The positioning mechanisms 34 unite together the auxiliary member 32 and the end plate member 33 with respect to the circumferential direction, thereby positioning them circumferentially by virtue of the engagement between the projections 34B and the auxiliary member 32 within grooves 34A, thereby enabling the members 32 and 33 to rotate together as one unit when the driving shaft 2 rotates, in substantially the same way as in the case of the positioning mechanism 25 in the first embodiment.

Thus, the second embodiment, arranged as described above, also makes it possible to obtain substantially the same advantages as those in the first embodiment. Particularly, in the second embodiment the auxiliary member 32 is in contact with the end plate member 33 only at the outer periphery thereof; therefore, it is possible to prevent the conduction of heat to the auxiliary member 32 from the central portion of the end plate 33A of the end plate member 33, where the rise in temperature due to compression heat is the greatest. Hence, it is possible to extend the lifetime of the auxiliary crank bearings 10 and 11.

Although in the above-described embodiments the auxiliary member 22 (32) and the end plate member 23 (33) are formed from different materials, it should be noted that the present invention is not necessarily limited thereto and that these two members may be formed from the same material.

Although in the first embodiment the annular plate portion 22A of the auxiliary member 22 is provided in contact with one end face of the end plate 23A of the end plate member 23, the present invention is not necessarily limited thereto. For example, a lubricating plate portion 41 of an insulative material may be provided between the annular plate portion 22A and the end plate 23A, as in a first modification shown in FIG. 5. The lubricating plate portion 41 may be provided in the form of a sheet or coating of a resin material having self-lubricating properties, e.g., polytetrafluoroethylene. In such a case, it is possible to lower the coefficient of friction between the annular plate portion 22A and the end plate 23A to thereby prevent wear of these members and it is also possible to prevent the conduction of heat from the end plate 23A to the annular plate portion 22A.

Although in the first embodiment the annular plate portion 22A of the auxiliary member 22 and the end plate 23A of the end plate member 23 are brought into contact with each other over the entire area from the center to the outer periphery and a single positioning mechanism 25 is provided inbetween the members 22 and 23, as shown in FIG. 2, the present invention is not necessarily limited thereto. For example, an annular wall portion 51 may be formed on the forward end face of the annular plate portion 22A, and the inner periphery of the wall portion 51 may be formed with three circumferentially spaced raised portions 52 that project toward the center, each raised portion 52 being formed with an engagement groove 25A, thereby providing three positioning mechanisms 25, as in a second modification shown in FIG. 6. In this case, the area of contact between the annular plate portion 22A and the end plate 23A can be reduced, and it is therefore possible to prevent the conduction of heat from the end plate 23A to the annular plate portion 22A. In addition, the annular wall portion 51, described in the second modification, may be omitted, as in a third modification shown in FIG. 7. In this case, the air in the casing 1 can be circulated through the gap defined between the annular plate portion 22A and the end plate 23A, so that it is possible to further improve the heat insulating properties between the annular plate portion 22A and the end plate 23A and it is also possible to cool the end plate 23A effectively.

Further, although in the second embodiment the annular wall portion 32C is integrally formed on the outer periphery at the forward end of the annular plate portion 32A of the auxiliary member 32 and it is provided with three raised portions 32E extending toward the center, the present invention is not necessarily limited thereto. For example, the annular wall portion 32C may be omitted, as in a fourth modification shown in FIG. 8. In this case also, the air in the casing 1 can be circulated through the gap defined between the annular plate portion 32A and the end plate 33A, thereby enabling an improvement in the heat insulating properties therebetween and allowing the end plate 32A to be cooled.

In addition, although in the described embodiments the engagement grooves 25A and 34A of the positioning mechanisms 25 and 34 are formed in the auxiliary members 22 and 32, while the engagement projections 25B and 34B are provided on the end plate members 23 and 33, the present invention is not necessarily limited thereto. For example, the engagement grooves may be formed in the end plate members 23 and 33, while the engagement projections are provided on the auxiliary members 22 and 32. Further, each engagement groove may extend in both the auxiliary member 22 (32) and the end plate member 23 (33).

In addition, although in the described embodiments the engagement projections 25B and 34B of the positioning mechanisms 25 and 34 are secured to the end plates 23A and 33A of the end plate members 23 and 33 by press fitting, the projections 25B and 34B may be secured by other securing means such as by bonding, welding, for example. Alternatively, the engagement projections 25B and 34B may be formed as integral parts of the end plates 23A and 33A.

Although in the described embodiments a ferrous material such as cast iron is mentioned as an example of a material which has a smaller coefficient of thermal expansion and a lower thermal conductivity than those of aluminum, other materials, e.g., stainless steel, may be employed in place of it.

Furthermore, the scroll fluid apparatus of the present invention can also widely be applied to compression of refrigerants, e.g., Freon gas, and other industrially used gases, e.g., nitrogen gas. If the scroll fluid apparatus is connected to a vacuum vessel, it can be used as a vacuum pump.

Thus, according to the present invention, when the end plate member expands radially due to a rise in the temperature caused by the compression heat in each compression chamber, the end plate member can be displaced radially without displacing the auxiliary member radially. As a result, even when the end plate member expands thermally, no radial load acts on the auxiliary cranks, so that it is possible to prevent breakage of the auxiliary cranks effectively. In addition, the revolving scroll can be revolved smoothly, so that it is possible to improve the compression efficiency and other performance as well as durability and reliability. It is also possible to effectively prevent the conduction of heat from the end plate member through the auxiliary member to the bearings supporting the auxiliary cranks. Hence, it is possible to extend the lifetime of the auxiliary crank bearings.

What is claimed is:

1. A scroll fluid apparatus comprising:

a cylindrical casing;

a drive shaft rotatably supported by said casing at one end portion of the casing, and having a crank at an end thereof located in the casing;

a revolving scroll having a first spiral scroll wrap and a boss portion which connects the revolving scroll to said crank for permitting orbiting movement of the revolving scroll;

a fixed scroll secured to the other end portion of said casing in opposing relation to said revolving scroll, said fixed scroll having an end plate and a second spiral scroll wrap which defines, in cooperation with said first scroll wrap, a plurality of compression chambers;

an auxiliary crank connected at one end thereof to said casing and at the other end thereof to the rear side of said revolving scroll; and said revolving scroll comprising an auxiliary member connected to said other end of said auxiliary crank, an end plate member disposed on the side of said auxiliary member which faces said fixed scroll member, said first scroll wrap being provided on the end plate member, and positioning means provided between said auxiliary member and said end plate member for preventing relative displacement between said auxiliary member and said end plate member in the circumferential directions thereof while allowing said end plate member to thermally expand radially outward relative to said auxiliary member, said positioning means including an elongate engagement groove extending radially in one of said auxiliary member and said end plate member and an engagement projection provided on the other of said auxiliary member and said end plate member, said engagement projection extending into said elongate engagement groove and engaging said other of said auxiliary member and said end plate member at a portion thereof defining sides of the elongate engagement groove.

2. A scroll fluid apparatus according to claim 1, wherein the material of said auxiliary member has a smaller coefficient of thermal expansion and a lower thermal conductivity than those of the material of said end plate member.

3. A scroll fluid apparatus according to claim 1, and further comprising a layer of an insulative material disposed between said auxiliary member and said end plate member.

4. A scroll fluid apparatus according to claim 1, wherein said auxiliary and said end plate members are fixedly secured together at the center of said end plate member.

5. A scroll fluid apparatus according to claim 1, wherein one of the auxiliary member and the end plate member includes an annular wall member extending along the outer periphery thereof and at least two raised portions extending radially thereof, said annular wall member and said raised portions constituting one of two opposing surfaces of the auxiliary member and the end plate member, and said positioning means comprises radially extending engagement grooves provided in said raised portions, respectively, and engagement projections extending from the other of said two opposing surfaces into said engagement grooves, respectively, said auxiliary member and said end plate member engaging each other only through said annular wall member and said raised portions.

6. A scroll fluid apparatus according to claim 5, and further comprising a layer of an insulative material disposed between said auxiliary member and said end plate member.

7. A scroll fluid apparatus according to claim 1, wherein one of the auxiliary member and the end plate member includes at least two raised portions extending radially thereof, said raised portions constituting one of two opposing surfaces of the auxiliary member and the end plate member, and said positioning means comprises radially extending engagement grooves provided in said raised portions, respectively, and engagement projections extending from the other of said two opposing surfaces into said engagement grooves, respectively, said auxiliary member and said end plate member engaging each other only through said raised portions.

8. A scroll fluid apparatus according to claim 7, and further comprising a layer of an insulative material disposed between said auxiliary member and said end plate member.

* * * * *